US006176029B1

(12) United States Patent
Maier-Hunke

(10) Patent No.: US 6,176,029 B1
(45) Date of Patent: Jan. 23, 2001

(54) INFORMATION SYSTEM DISPLAY PANEL

(75) Inventor: Horst-Werner Maier-Hunke, Iserlohn (DE)

(73) Assignee: "Durable" Hunke & Jochheim GmbH & Co. KG, Iserlohn (DE)

( * ) Notice: Under 35 U.S.C. 154(b), the term of this patent shall be extended for 0 days.

(21) Appl. No.: 09/214,238

(22) PCT Filed: Jul. 17, 1997

(86) PCT No.: PCT/DE97/01551

§ 371 Date: Dec. 28, 1998

§ 102(e) Date: Dec. 28, 1998

(87) PCT Pub. No.: WO98/03351

PCT Pub. Date: Jan. 29, 1998

(30) Foreign Application Priority Data

Jul. 17, 1996 (DE) ..... 296 13 107 U

(51) Int. Cl.[7] ..... G09F 3/18

(52) U.S. Cl. ..... 40/661; 40/649; 40/654.01

(58) Field of Search ..... 40/649, 661, 654.01, 40/734, 781, 405, 537

(56) References Cited

U.S. PATENT DOCUMENTS

| | | | | |
|---|---|---|---|---|
| 4,104,818 | * | 8/1978 | Hrabik | 40/781 X |
| 4,507,885 | | 4/1985 | Kinnard . | |
| 5,148,618 | * | 9/1992 | Brewster | 40/661 X |
| 5,887,373 | * | 3/1999 | Byers | 40/781 X |

FOREIGN PATENT DOCUMENTS

| | | | | |
|---|---|---|---|---|
| 207872 | * | 1/1987 | (EP) | 40/661 |
| 1463195 | | 11/1966 | (FR) . | |

* cited by examiner

*Primary Examiner*—B. Dayoan
*Assistant Examiner*—James M Hewitt
(74) *Attorney, Agent, or Firm*—Mark P. Stone

(57) ABSTRACT

An information display panel has a plastic frame surrounding two transparent foils (4, 5), that form an envelope. The frame (1) is formed from two halves interconnected by locking couplings so that peripherally welded seams are eliminated.

13 Claims, 1 Drawing Sheet

INFORMATION SYSTEM DISPLAY PANEL

BACKGROUND OF THE INVENTION

The invention relates to an information system display panel in which cylindrical pins or holes for hanging in holding devices of stands, folders or the like are arranged in the region of the ends of one edge of a plastic frame holding a pocket formed by transparent films.

There are known display panels of the abovementioned type in which the frame and the edges of the pocket formed by the transparent films are joined together by welding, one of the transparent films being welded permanently into the frame along four edges and one of the transparent films being welded permanently into the frame along three edges. The known welded joins not only entail an undesirably high expenditure of energy, they are also not fully satisfactory with regard to the working result which can be achieved with them. The invention is based on the object of providing a display panel of the type under consideration which, while taking ecological aspects into account, can be produced cost-effectively and meets high requirements with regard to its appearance. This object is achieved according to the invention by the frame comprising two frame halves which are joined together by locking couplings and hold at least three respective edges of two transparent films forming the pocket.

SUMMARY OF THE INVENTION

The display panel according to the invention offers the advantage that the parts forming it can be fitted together quickly and unproblematically and there is no need for peripheral welds. Unlike in the case of known welded frames, the outside surfaces of the frame can be of a smooth design and consequently so-called dirt traps are not formed.

BRIEF DESCRIPTION OF THE DRAWINGS

Further details and features of the invention emerge from the subclaims and the following description of a particularly advantageous embodiment of the invention represented in the attached drawing, in which:

DESCRIPTION OF THE BEST MODES FOR CARRYING OUT THE INVENTION

Figure 1:
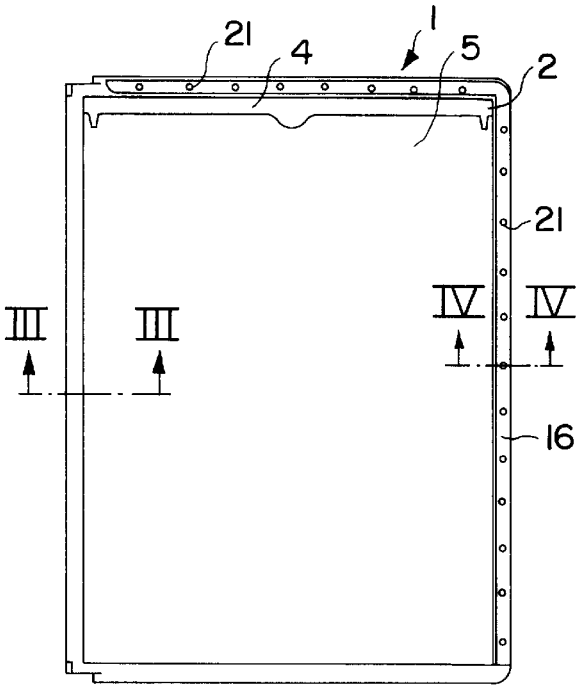
FIG. 1 shows the plan view of a display panel.
Figure 3:
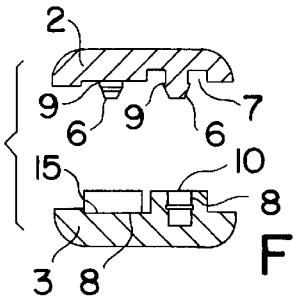
FIG. 3 shows on an enlarged scale a section through the frame halves in the region of a joining point.
Figure 4:
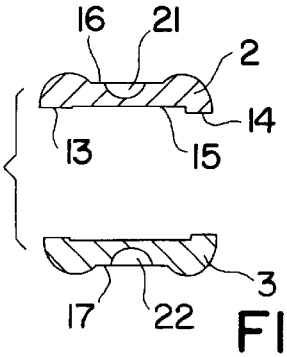
FIG. 4 shows on an enlarged scale a section through the frame parts in the region of a locking recess for an index-tab and FIG. 5 shows an index-tab suitable for fitting on the frame of the display panel.
Figure 5:
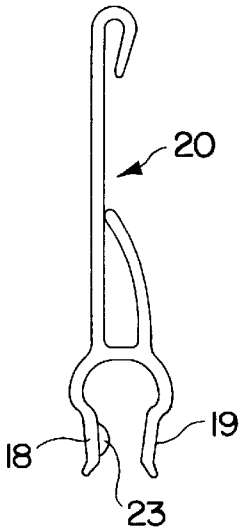

In FIG. 1, 1 denotes the frame of a display panel which comprises two halves 2, 3, between which two transparent films 4 and 5 of different sizes are clamped. While the transparent film 4 facing the half 3 forming the rear side of the frame 1 is held in the frame 1 along all of its four edges, the transparent film 5 facing the half 2 forming the front side of the frame 1 is anchored on the frame 1 only along three edges. The transparent films 4 and 5 may consist of one piece, which is folded in the region of the lower edge of the frame 1. Two rows of locking couplings, the structural design of which is shown by FIG. 3, serve for joining the frame halves 2, 3. Each locking coupling comprises a pin 6, which is surrounded by an annular centering groove 7, and a socket 8, which is closed at its lower end and the free end of which can enter into the centering groove 7. The pin 6 is provided with an edge bead 9, which in the locked-in state grips into a locking groove 10 on the inside wall of the socket 8.

Figure 2:
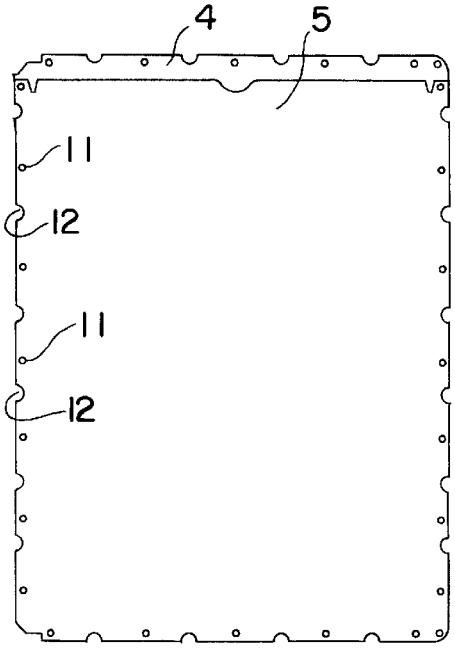
FIG. 2 shows the plan view of two transparent films placed one on top of the other.

The pins 6 and sockets 8 of the inner row of locking couplings pass clearances 11 formed in the transparent films 4 and 5 by punched holes. While the pins 6 and sockets 8 of the inner row of locking couplings are fully enclosed by the transparent films 4 and 5 in the region of the edges thereof, the pins 6 and 8 of the outer row of locking couplings are surrounded only partially by likewise punched semicircular clearances 12. As can be seen from the clearances 11 and 12 in FIG. 2, the locking couplings of the adjacently arranged rows of locking couplings are arranged offset with respect to one another in the longitudinal direction of the rows of couplings. To ensure flush contact in the region of the peripheral outer joint of the frame halves 2 and 3, the elements of the locking couplings to be coupled lie in a strip-shaped region 15 of the mutually facing sides of the frame halves 2, 3 bounded by flat fillets 13, 14, the height of the outer fillets 14 being greater than the height of the inner fillets 13 by an amount taking account of the thickness of the transparent films 4, 5.

At least part of the edges of the frame halves 2, 3 is provided on the front and rear side of the frame 1 with guide grooves 16, 17 for the legs 18, 19 of index-tabs 20, locking recesses 21 and 22 into which locking projections 23 of the index-tabs 20 can engage serving for the positional securement of the index-tabs 20. To be able to alter the positions of the index-tabs 20 in small steps, the locking recesses 21 on the front side of the frame 1 are arranged offset with respect to the locking recesses 22 on the rear side of the frame 1.

What is claimed is:

1. In an information system display panel in which cylindrical pins or holes for hanging in holding devices of stands or folders are arranged at ends of one edge of a plastic frame (1) holding a pocket formed by transparent films (4, 5), the improvement comprising said frame (1) comprising two frame halves (2, 3) which are joined together by locking couplings and hold a pocket which is formed by two transparent films (4, 5) of different sizes, each of said transparent films having a plurality of edges, one of said transparent films being held by the couplings between the frame halves (2, 3) along three of its edges, said three edges including a plurality of holes, and the other of said transparent films being held between the frame halves (2, 3) along four of its edges, said four edges including a plurality of holes.

2. Display panel according to claim 1, wherein each of the locking couplings are formed from a plurality of press pins, at least a portion of each of said pins providing anchoring means for the edges of the films, said holes in said edges receiving said pins.

3. Display panel according to claim 1, wherein the frame defines a periphery, and said locking couplings form two rows of locking couplings which extend over the periphery of the frame (1).

4. Display panel according to claim 3, wherein the locking couplings of one row of locking couplings are arranged offset with respect to the locking couplings of the other row of locking couplings in a longitudinal direction of the rows of couplings.

5. Display panel according to claim 1, wherein the locking couplings to be coupled are arranged in a strip-shaped region (15) of mutually facing sides of the frame halves (2, 3), said strip-shaped region being bounded by flat fillets (13, 14).

6. Display panel according to claim 1, wherein the transparent films (4, 5) are provided with clearances at their edges (11, 12) which enclose at least part of the locking couplings.

7. Display panel according to claim 1, wherein the locking couplings comprise pins (6) provided on one of said frame halves (2, 3) and sockets (8) provided on the other of said frame halves (2, 3), each of said pins having an edge bead (9), and each of said sockets having a locking groove (10), said sockets being closed in a direction toward said frame half on which said sockets are provided, said sockets having free ends which are received in centering grooves (7) surrounding each of said pins.

8. Display panel according to claim 1, wherein the frame (1) includes a front side and a rear side, and each of said frame halves is provided with guide grooves (16, 17) for legs (18, 19) of index-tabs (20) in the region of at least one edge of at least one of said front and rear sides.

9. Display panel according to claim 8, wherein the legs (18, 19) of the index-tabs (20) are provided with at least one locking projection (23) and the guide grooves (16, 17) are provided with a plurality of locking recesses (21, 22).

10. Display panel according to claim 9, wherein the locking recesses (21) on the front side of the frame (1) are arranged offset with respect to the locking recesses (22) on the rear side of the frame (1).

11. Display panel according to claim 8, wherein locking recesses (21) are provided on the front side of the frame (1) and locking recesses (22) are provided on the rear of the frame (1) and the distance between each of the locking recesses (21) on the front side of the frame (1) is different from the distance between each of the locking recesses (22) on the rear side of the frame (1).

12. Display panel according to claim 2, wherein the frame defines a periphery, and said locking couplings form two rows of locking couplings which extend over the periphery of the frame (1).

13. Display panel according to claim 9, wherein the distance between each of the locking recesses (21) on the front side of the frame (1) is different from the distance between each of locking recesses (22) on the rear side of the frame (1).

* * * * *

UNITED STATES PATENT AND TRADEMARK OFFICE

CERTIFICATE OF CORRECTION

PATENT NO. : 6,176,029 B1
DATED : January 23, 2001
INVENTOR(S) : Horst-Werner Maier-Hunke It is certified that error appears in the above-identified patent and that said Letters Patent is hereby corrected as shown below:

Claim 11,
Line 3 (Column 4, Line 7), after "rear", add -- side --.
Line 4 (Column 4, Line 8), after "frame (1)", add -- , --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*